United States Patent [19]

Lallemand

[11] Patent Number: 4,763,363

[45] Date of Patent: Aug. 16, 1988

[54] TOILET LOCKING APPARATUS

[76] Inventor: Albert A. Lallemand, 1323-B E. Pl. Valley Blvd., Altoona, Pa. 16602

[21] Appl. No.: 525,689

[22] Filed: Aug. 23, 1983

[51] Int. Cl.[4] ..... A47K 13/00

[52] U.S. Cl. ..... 4/253; 292/288

[58] Field of Search ..... 4/253; 292/259, 288

[56] References Cited

U.S. PATENT DOCUMENTS

| | | | |
|---|---|---|---|
| 955,563 | 4/1910 | Urban | 292/288 |
| 1,084,817 | 1/1914 | Parkinson | 292/288 |
| 2,404,124 | 7/1946 | Des Roches | 4/253 |
| 2,558,578 | 6/1951 | Palmieri | 4/253 |
| 2,724,125 | 11/1955 | Williams | 4/253 |
| 3,048,854 | 8/1962 | Miller | 4/253 |
| 4,145,771 | 3/1979 | Khazin | 4/253 |

*Primary Examiner*—Henry J. Recla
*Assistant Examiner*—Linda J. Sholl
*Attorney, Agent, or Firm*—Arnold B. Silverman

[57] ABSTRACT

An improved toilet locking apparatus of the type comprising a strap element having a clip attached at each end thereof for securing a toilet lid and seat in a closed position on a toilet bowl is provided. An improved first clip device is secured to a front or side portion of the internal spillway of a toilet bowl rim. A second improved clip device having a shape substantially similar to the first clip device but having a reduced dimension may removably engage a back or side portion of a toilet lid thereby allowing one to easily and efficiently lock or unlock the toilet lid by simply moving the second clip device outwardly. A notch is provided in a bottom portion of the first clip device so that water released from the toilet spillway rim may freely pass therethrough and to receive the small ceramic ball provided under the spillway rim of certain toilet bowls. Slots are provided in top portions of each clip device so that an elastic strap may be permanently attached therethrough.

15 Claims, 2 Drawing Sheets

TOILET LOCKING APPARATUS

BACKGROUND OF THE INVENTION

1. Field of the Invention

This invention relates to an improved toilet locking apparatus and, more specifically, it relates to a toilet seat locking device which allows the user to more easily lock and unlock the toilet seat cover.

2. Description of the Prior Art

In modern households, young children are exposed to many hazards. One such hazard, found in the bathroom is the toilet bowl. When the toilet seat or lid is left in an open position, there is a risk that the seat or lid might accidently fall and injure the child. Even when the seat or lid is left in a closed position, there is the risk that young children might injure themselves in an attempt to lift the seat. An additional risk presented by a toilet bowl is the unsanitary condition of the water therein, which is often further contaminated by the addition of harmful disinfecting and deodorizing chemicals. This unhealthful water often attracts the attention of children who are too young to appreciate the danger. By far the most severe risk presented by an open toilet bowl is that a small child might lose his balance and fall into the bowl and drown.

In an effort to overcome some of the above-mentioned risks, a number of locking devices have been suggested. U.S. Pat. No. 4,145,771, for example, discloses a three-piece toilet bowl lock having a first mounting bracket attached to the top of the cover or lid and a second mounting bracket attached to the bowl. A plastic lock strap is provided between these mounting brackets and holds the toilet lid in a closed position. A problem with that device is that permanent attachment of mounting brackets in an undesirable location is required.

U.S. Pat. No. 2,724,125 discloses a toilet seat lock which is made of a metal strap material. A problem with that device is that it is bulky, expensive to produce and is somewhat difficult to use.

U.S. Pat. No. 2,558,578 discloses a toilet seat restraint wherein a lower strap element is locked around the lower portion of the toilet bowl, and a pair of strap elements are connected to an upper strap which wraps around the hinge pin of the toilet seat and is secured by a buckle. This device uses more material than the present invention and because a buckle is utilized which is somewhat awkward to operate, it is not ideal.

U.S. Pat. No. 2,404,124 discloses a toilet bowl lock providing a pair of generally channel shaped, rod-formed hook members which are adapted to hook onto the internal bead of a toilet. An elastic strap is connected to each of these hooks and the two straps are connected together by a buckle element. The use of a buckle and the need to release a hook from the bowl bead in order to be able to use the toilet make this system cumbersome.

U.S. Pat. No. 3,048,854 discloses a toilet seat covering device having a first clip which engages the rear portion of the internal bead of the toilet and a second clip which engages the front edge of the seat of the toilet. An elastic strap connects the two clips. A problem with this device is that one of the clips is connected to the elastic strap through a fastening rod and keeper plate arrangement which increases the number of elements and thereby its complexity and cost.

In view of the fact that many of these devices are difficult to use, even for normal healthy persons, many disabled or handicapped persons have heretofore been precluded from operating and using such devices. As a result, the children of such persons have been unnecessarily subjected to the above-mentioned risks.

There remains, therefore, a very real and substantial need for a toilet locking device which is economical to manufacture and use, is effective as a locking device and yet is truly easy to lock and unlock.

SUMMARY OF THE INVENTION

An improved toilet locking apparatus of the type comprising a strap means having clip means connected at each end is disclosed. A first clip is adapted to engage the front portion of the toilet bowl's internal spillway bowl rim and is attached to one end of an elastic strap. A second clip member which is attached to the opposite end of the elastic strap removably engages a rear edge of the toilet lid in order to hold the lid in a closed position. The present invention provides cost savings by requiring use of only the above-mentioned three elements. The ease by which the locking device can be attached and released encourages its use and provides a more efficient means to secure the toilet lid than prior art devices.

It is an object of the present invention to provide a toilet locking apparatus which allows for easy locking and unlocking of a toilet lid to a toilet bowl.

It is another object of the present invention to provide clips made of either plastic or a solid transparent resinous material of the type sold under the trademark Plexiglas and an elastic strap member connecting said clips.

It is yet another object of the invention to provide a first clip which engages the toilet bowl's spillway rim in a manner which does not interfere with the flow of water from the spillway and which may receive the small ceramic ball found under the spillway of certain toilet bowls.

It is yet another object of the invention to provide a second clip which may be easily attached to or removed from an edge of the toilet bowl lid.

It is a further object of the present invention to provide a toilet locking apparatus which can be efficiently mass produced thereby creating substantial cost savings.

These and other objects of the present invention will be more fully understood from the following description on reference to the illustrations appended hereto.

DESCRIPTION OF THE PREFERRED EMBODIMENTS

Figure 1:
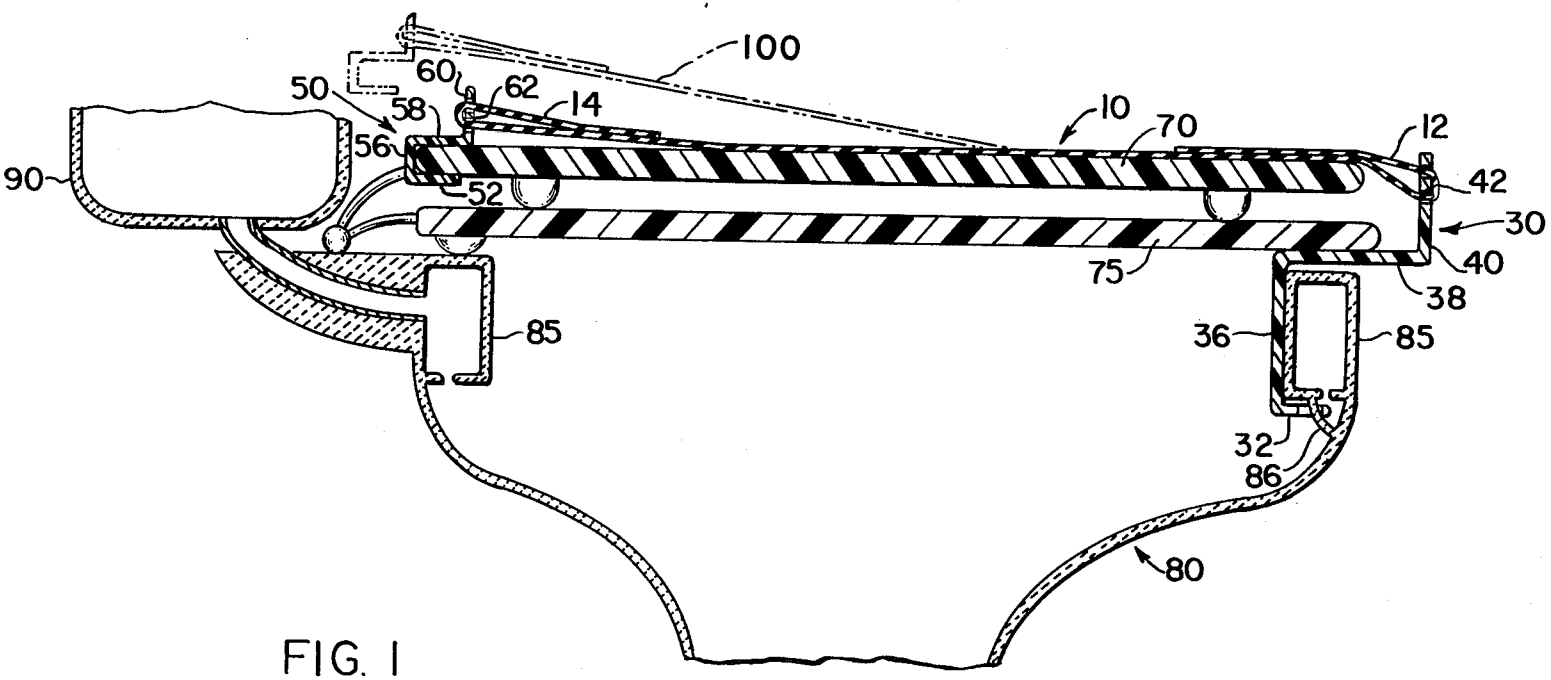
FIG. 1 is a longitudinal cross-sectional view of a toilet locking apparatus according to the present invention showing a toilet bowl lid and seat as secured to a toilet bowl and also showing in chain line how said apparatus is released.

Referring specifically to FIG. 1 a longitudinal cross-sectional view of a locking apparatus according to the present invention is shown. The present invention provides a locking apparatus of the type comprising a strap means 10 having a first clip means 30 attached at or adjacent to one end thereof and a second clip means 50 attached at or adjacent to the opposite end thereof. The device is utilized for securing a toilet lid 70 and seat 75 in a closed position on a toilet bowl 80. Toilet bowl 80 has an internal annular spillway bowl rim portion 85 which, as shown, has a generally rectangular transverse cross-sectional configuraticn.

Clip means 30 is preferably fabricated from a solid transparent resinous material of the type sold under the trademark Plexiglas or from any other suitable material such as plastic and is designed to engage spillway 85. Clip 30 has a generally horizontally oriented bottom portion 32, a generally vertically oriented second portion 36 having a lower portion thereof connected to bottom portion 32, a horizontally oriented third portion 38 having one end thereof connected to an upper portion of said second portion 36 and having an opposite end thereof attached to a vertically oriented fourth portion 40 as shown. End 12 of strap means 10 is preferably attached to said fourth portion 40 through opening 42 provided near the upper edge thereof. The clip 30 may advantageously be formed as a unit, as by molding, for example.

Clip means 50 may be of generally similar profile to clip means 30 but of reduced dimension. Clip means 50 also has a horizontally oriented bottom portion 52, a vertically oriented second portion 56 having a lower portion thereof connected to said bottom portion 52, a horizontally oriented third portion 58 having one portion thereof attached to said second portion 56 and a vertically oriented fourth portion 60 attached to an opposite edge of said third portion 58. Opposite end 14 of strap means 10 is attached to said fourth portion 60 of clip means 50 through opening 62. To unlock the device, clip means 50 is manipulated rearwardly toward toilet bowl tank 90 and then lifted upwardly against the force of elastic strap means 10 in the position shown by chain line 100, thereby releasing the lid and seat each of which may then be freely lifted.

Figure 2:
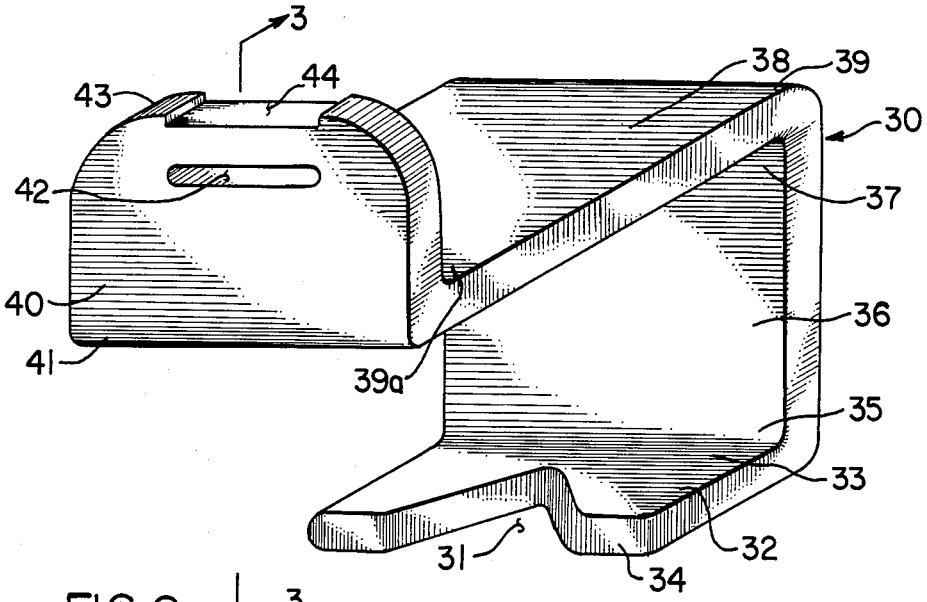
FIG. 2 is an isometric view of a first clip means which is designed to engage the internal spillway bowl rim of a toilet bowl.
Figure 3:
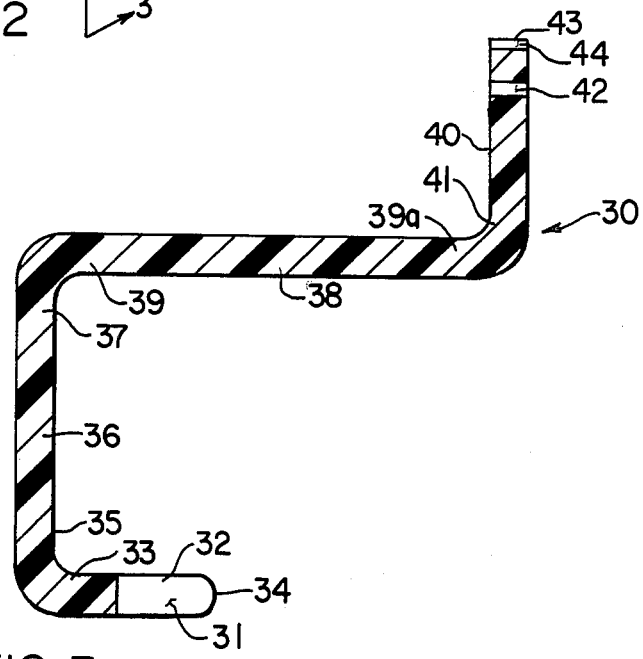
FIG. 3 is a longitudinal cross-sectional view of the clip means shown in FIG. 2 taken on the line 3—3 of that Figure.

Referring more specifically to FIGS. 2 and 3, isometric and cross-sectional views of first clip means 30 are shown. A substantially flat and rectangular bottom portion 32 is designed to rest beneath the internal spillway bowl rim 85. A notch 31 is provided inwardly in said bottom portion from edge 34 so that water released from said spillway rim may freely pass therethrough. Notch 31 is also provided to receive the small ceramic bead or ball 86 which may be found under the rim of spillway 85 on some toilet bowls to aid in pushing the water to the drain. Connected to portion 33 of bottom portion 32 is a lower portion 35 of a substantially flat and rectangular second portion 36 which extends generally vertically upward therefrom. The upper portion 37 of second portion 36 is connected to portion 39 of a substantially flat and rectangular third portion 38 which extends in a substantially horizontal plane so that said third portion is in spaced parallel relationship with respect to said bottom portion 32. Connected to opposite portion **39*a* of third portion 38 is a lower portion 41 of a substantially flat and rectangular fourth portion 40 which extends vertically upward therefrom. Fourth portion 40 has a centered slot 42 therein, sized to receive said strap means, and is positioned near upper edge 43 of fourth portion 40 as shown. A small notch 44 is provided directly above slot 42 to resist undesired lateral motion of said strap means 10**.

Figure 4:
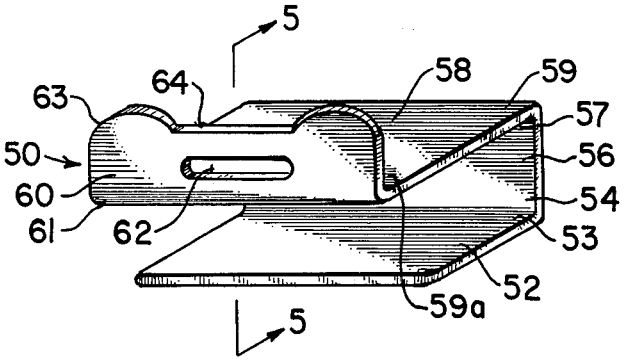
FIG. 4 is an isometric view of a second clip means designed to removably engage the back edge of a toilet lid.
Figure 5:
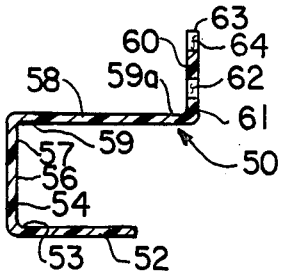
FIG. 5 is a longitudinal cross-sectional view of the clip means shown in FIG. 4 taken on the line 5—5 of that Figure.

Referring now to FIGS. 4 and 5, isometric and cross-sectional views of second clip means are shown. Clip means 50 has a substantially flat and rectangular bottom portion having one portion 53 thereof connected to lower portion 54 of a second portion 56 which extends generally vertically upward therefrom. An upper portion 57 of a second portion 56 is connected to one portion 59 of a substantially flat and rectangular third portion 58 which extends in a substantially horizontal plane so that said third portion is spaced-above and parallel to said bottom portion 52. Opposite portion **59*a* of said third portion 58 is connected to a lower portion 61 of a substantially flat and vertically oriented fourth portion 60. Fourth portion 60 has a centered slot 62 therein sized to receive said strap means 10. Slot 62 is positioned near upper edge 63 of fourth portion 62. A notch 64 is provided directly above slot 62** for the reasons listed above.

It is contemplated that the present invention may be utilized with any suitable strap means although a rubber, or other lastic strap means is preferred. Ends 12 and 14 of strap means 10 are preferably formed into loops by folding over said ends and securing them to the strap by any suitable means. Ends 12 and 14 are preferably either vulcanized or glued in place as staples or sewing may prove to be somewhat less desirable. Note that slots 42 and 62 and notches 44 and 64 resist undesired lateral motion of said strap means 10. As these loops pass through slots 42 and 62, the need for any type of buckling device is eliminated. Since the device has no buckle, it may be easily removed in the manner described above. Because the device has only three elements, it can be produced at a significantly lower cost than commercially available toilet locks.

Whereas particular embodiments of the invention have been described above for purposes of illustration, it will be appreciated by those skilled in the art that numerous variations of the details may be made without departing from the invention as described in the appended claims.

I claim:

1. An improved toilet locking apparatus of the type comprising a strap means having clip means attached at each end thereof for securing a toilet lid and seat in a closed position onto a toilet bowl having an internal annular spillway bowl rim wherein the improvement comprises providing clip means further comprising:

a generally flat bottom portion oriented in a substantially horizontal plane;

a generally flat second portion having one portion thereof connected to one portion of said bottom portion and extending vertically upward therefrom;

a substantially flat third portion having one portion thereof connected to another portion of said second portion and extending in a substantially horizontal plane so that said third portion is in spaced parallel relationship with respect to said bottom portion; and a substantially flat fourth portion having one portion thereof connected to another portion of said third portion and extending vertically upward therefrom, first said clip means is sized to engaging a portion of said spillway rim, the second said clip means is sized to engaging a portion of said toilet lid, said first clip means being larger than said second clip means, and said strap means being elastic.

2. A locking apparatus according to claim 1 wherein said spillway bowl rim has a generally rectangular cross-sectional configuration.

3. A locking apparatus according to claim 1 wherein said bottom, second and third portions are generally rectangular in shape.

4. A locking apparatus according to claim 1 wherein said first clip means is complimentary with respect to said spillway rim and has said bottom, second and third portions sized to engage said spillway rim.

5. A locking apparatus according to claim 4 wherein the bottom portion of said first clip means has a notch therein so that water released from said spillway rim may freely pass therethrough.

6. A locking apparatus according to claim 5 wherein the bottom portion of said first clip means has a notch therein sized to receive a ceramic ball of the type provided under the spillway rim on certain toilet bowls.

7. A locking apparatus according to claim 1 wherein the bottom portion of said first clip means has a notch therein so that water released from said spillway rim may freely pass therethrough.

8. A locking apparatus according to claim 1 wherein the bottom portion of said first clip means has a notch therein sized to receive a ceramic ball of the type provided under the spillway rim on certain toilet bowls.

9. A locking apparatus according to claim 1 wherein said fourth portion has a slot therein sized to receive said strap means, said slot provided at or near an upper edge of said portion.

10. A locking apparatus according to claim 1 wherein said clip means is made of a solid transparent resinous material.

11. A locking apparatus according to claim 1 wherein said clip means is made of plastic.

12. A locking apparatus according to claim 1 wherein said strap means is elastic.

13. A locking apparatus according to claim 12 wherein said strap means is rubber.

14. A locking apparatus according to claim 1 wherein said first clip means is secured to a front portion of said spillway rim and said second clip means removably engages a rear edge of said toilet lid.

15. A locking apparatus according to claim 1 wherein said first clip means is secured to a side portion of said spillway rim and said second clip means removably engages a side portion of said toilet lid.

* * * * *